US005215383A

United States Patent [19]

Hilton

[11] Patent Number: 5,215,383

[45] Date of Patent: Jun. 1, 1993

[54] TICKET STOCK AND TICKET DISPENSER

[75] Inventor: Graham H. Hilton, San Diego, Calif.

[73] Assignee: Cubic Automatic Revenue Collection Group, San Diego, Calif.

[21] Appl. No.: 633,105

[22] Filed: Dec. 19, 1990

[51] Int. Cl.[5] ..... B41J 11/26

[52] U.S. Cl. ..... 400/621; 400/105; 225/103; 226/143

[58] Field of Search ..... 400/621, 105, 608.3; 101/224, 226, 228; 225/93, 103, 106; 226/143; 83/879

[56] References Cited

U.S. PATENT DOCUMENTS

| | | | |
|---|---|---|---|
| 4,043,440 | 8/1977 | Busch | 101/228 |
| 4,211,498 | 7/1980 | Shimizu | 83/879 |
| 4,981,378 | 1/1991 | Kramer | 400/621 |
| 5,062,722 | 11/1991 | Shiozaki et al. | 226/143 |
| 5,066,153 | 11/1991 | Stephens | 400/621 |
| 5,092,697 | 3/1992 | McKenna | 225/106 |
| 5,133,615 | 7/1992 | Saito et al. | 400/621 |
| 5,159,350 | 10/1992 | Minaminaka | 400/621 |

FOREIGN PATENT DOCUMENTS

| | | | |
|---|---|---|---|
| 3522022 | 1/1986 | Fed. Rep. of Germany | 400/621 |

*Primary Examiner*—Eugene H. Eickholt

*Attorney, Agent, or Firm*—Brown, Martin, Haller & McClain

[57] ABSTRACT

A continuous strip of ticket stock from which individual tickets can be separated includes an elongated strip of a ticket stock material and, at each preselected ticket-separation location, a collinear transversely extending perforation, bursting slot, and slit at each end of the bursting slot. A ticket dispenser for dispensing individual tickets from such a strip of stock includes a drive mechanism that drives the strip of ticket stock in both a forward direction and a reverse direction through a bursting station. The bursting station includes a burst barb, and a guide that permits the strip of ticket stock to move past the burst barb when the strip of ticket stock is driven in the forward direction, and to engage the burst barb to the bursting slot when the strip of ticket stock is driven in the reverse direction. The burst barb propagates a separation from the bursting slot outwardly through the perforation to separate the individual ticket cleanly from the strip.

6 Claims, 4 Drawing Sheets

TICKET STOCK AND TICKET DISPENSER

BACKGROUND OF THE INVENTION

This invention relates to continuous strip ticket stock, and to apparatus for producing an individual ticket from such stock.

Tickets have routinely been used as a kind of receipt for payment and entitlement to the goods or services paid for. As such, tickets have usually been pre-printed with information. A patron pays for the ticket at one location, and then exchanges the ticket for the goods or services at another location. If more than one type of good or service is available, a corresponding number of types of pre-printed tickets are made available and the correct one provided at the time of payment.

In an increasingly information dependent world, it is often desirable to custom print and to magnetically encode information on a ticket and then dispense the ticket from an automated module. The information on the ticket is used both to ensure that the patron gets what he or she is entitled to, and also to convey information to the seller about how the ticket is used As an example, transfers have long been provided by mass transit systems so that patrons may switch from one line to another with a smaller additional payment than if the full fare for both lines was paid. A patron could obtain a pre-printed transfer on one line, and then use that transfer on another. While this system works, it permits occasional abuses, such as a patron using the transfer in an unintended manner, and also does not readily give an indication of how transfers are being used. If, to cite one case, the transit system finds a very large use of transfers of a particular pattern, additional transit vehicles might be assigned or new patterns of routes might be devised.

To improve mass transit service, many transit systems used tickets that are custom printed and magnetically encoded with route, date, time, and other information useful in system management. In the case of the transfer type of ticket, the ticket must be printed, encoded, and dispensed quickly and efficiently, because the ticket is often provided at the driver's station of a bus or streetcar with a line of patrons awaiting service. The ticket material is preferably provided as a long length of rolled or fan-fold stock, because the handling of pre-out tickets requires additional machinery and is therefore less reliable. The dispensing machinery must be able to print, encode, and dispense a single ticket from the ticket stock. It is important that the dispensed ticket be separated cleanly from the stock so that it can be read by automated fare collection equipment at a later time. However, one of the parts of the system most vulnerable to breakdowns is the ticket cutter. Also, existing transfer issuing equipment requires as much as about 3 seconds to dispense a transfer.

There is a need for an improved approach to providing patrons with custom-printed and encoded tickets in a fast, reliable manner. The present invention fulfills this need, and further provides related advantages.

SUMMARY OF THE INVENTION

The present invention provides a ticket stock and ticket dispenser that cooperate to permit fast, reliable dispensing of a ticket to a patron. The ticket dispenser does not include any sort of paper cutter, and instead achieves separation of individual tickets from the strip of ticket stock with no moving parts other than the ticket transfer mechanism that moves the ticket stock from the supply through the printer and to the patron. A ticket can be printed and dispensed in less than one second. The ticket stock is sufficiently robust to be handled in either roll or fan-fold form, permitting easy reloading of the dispenser In the preferred form of the invention, information is both printed onto the ticket in human-readable form and encoded onto a magnetic stripe on the ticket in a machine-readable form. The magnetically encoded information is verified before the individual ticket is separated and dispensed to the patron.

As indicated, the ticket stock and ticket dispenser cooperate in achieving the improved results of the invention. In accordance with the ticket stock aspect of the invention, a continuous strip of ticket stock from which individual&tickets can be separated comprises an elongated strip of a ticket stock material; and means on the ticket stock material for aiding in the separation of individual tickets from the strip of ticket stock, the means for separating including at least one perforation, a bursting slot, and a slit at an end of the bursting slot, the perforation, the bursting slot, and the slit being substantially collinear and extending transversely to the direction of elongation of the strip of ticket stock material at each preselected ticket end location The preferred ticket stock has pre-cut transverse perforations, bursting slot, and slits at each end of the bursting slot. These dispensing aids are placed at each separation location that marks the end limits of each ticket. As will be discussed, the bursting slot is engaged by a burst barb on the dispenser, so that the ticket readily tears along the perforation. The slits serve as stress concentrators at the ends of the bursting slot that help initiate the paper tearing. Tests have established that this approach to the ticket stock is sufficiently robust that the ticket stock does not come apart either during normal handling or passage through the dispenser, prior to each individual ticket being intentionally separated.

In accordance with the apparatus aspect of the invention, a dispenser that separates a single ticket from an elongated strip of ticket stock having a transverse bursting slot therein at the location whereat the single ticket is to be separated comprises means for driving a strip of ticket stock in both a forward direction and a reverse direction along the direction of elongation: means for separating a single ticket from the strip, comprising a burst barb, and means for permitting the ticket to move past the burst barb when the strip of ticket stock is driven in the forward direction, and for engaging the burst barb into a bursting slot in the strip of ticket stock when the strip of ticket stock is driven in the reverse direction, the means for separating having no paper cutter therein.

In the preferred approach, the information is magnetically encoded onto the magnetic stripe of the ticket in a first reverse pass past the encoding head, from the starting position dictated by dispensing of the prior ticket. The direction of movement of the ticket drive is changed to the forward direction, and the encoded information is read from the ticket and verified in that forward pass. Information is printed onto the ticket as it moves past the printing head in either direction. To separate an individual ticket from the ticket stock, the mechanism drives &he ticket stock past the burst barb in a continuation of the forward movement, and then reverses the direction of movement to engage the burst barb into the bursting slot As the engagement proceeds, the ticket stock is bent slightly so that a tear begins to propagate transversely outwardly from the slits at each end of the bursting slot, along the locus of the perforations. The ticket snaps away from the ticket stock, and must be retained so that the patron can grasp it. The torn edge is quite clean, and the ticket is not permanently deformed by the separation process. The individual ticket is suitable for subsequent reading in automatic fare collection equipment. The ticket stock is then positioned and ready for printing and encoding the next ticket, with no wasted motion. Significantly, no paper cutting in the conventional sense of a moving blade is required, nor is a separate mechanism to tear the ticket along perforations.

Thus, the present invention provides a ticket stock and dispenser that print and dispense tickets quickly and reliably. Other features and advantages of the invention will be apparent from the following more detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
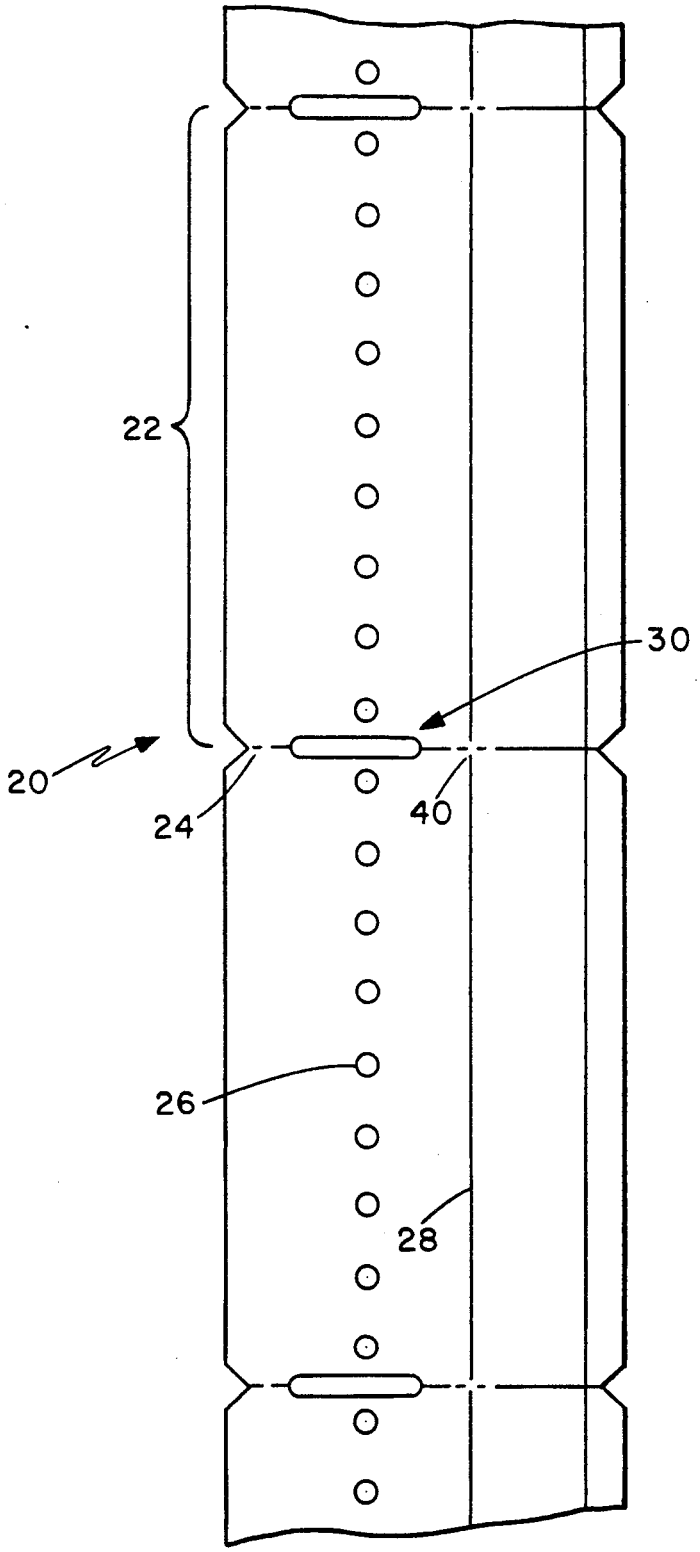
FIG. 1 is a plan view of a preferred ticket stock.
Figure 2:
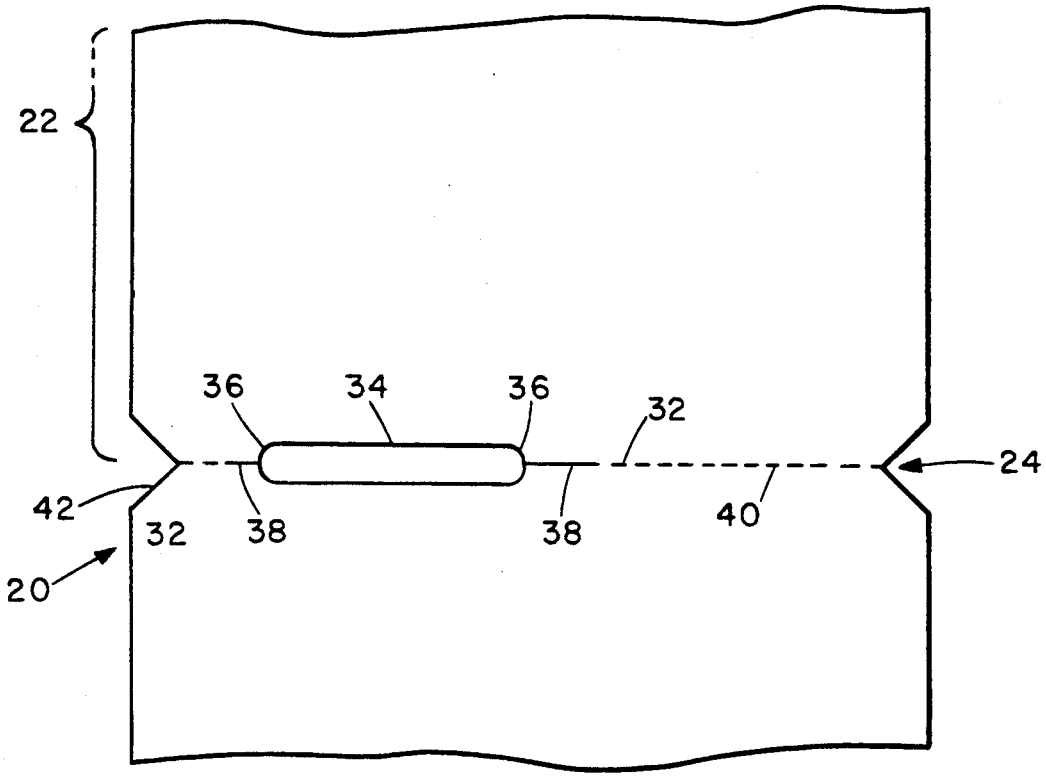
FIG. 2 is a detail of the preferred ticket stock, without cog drive holes and a magnetic stripe.
Figure 3:
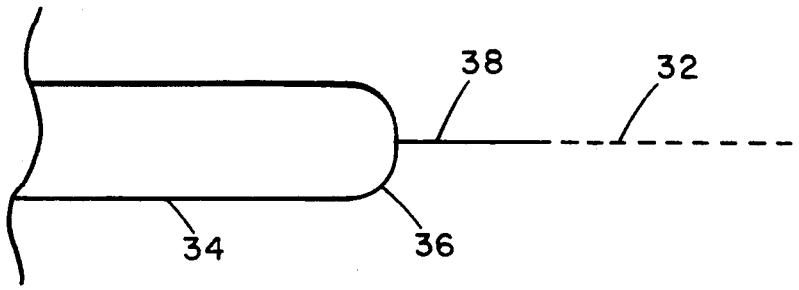
FIG. 3 is a further enlarged detail of FIG. 2.

A preferred ticket stock 20 is illustrated in FIG. 1, and a slightly modified version is illustrated in detail in FIGS. 2 and 3. The ticket stock 20 is made of plasticized paper having a thickness of up to about 0.012 inches, which is available commercially from gand McNally. However, the ticket stock material is not so limited, and may be made of other suitable materials.

The ticket stock 20 is provided in a continuous feed or strip form, with multiple individual tickets 22 joined together at the ticket ends 24. In the preferred form illustrated in FIG. 1, a series of tractor drive cog holes 26 extend longitudinally along the length of the ticket stock 20. A magnetic stripe 28 also extends longitudinally along the length of the ticket stock 20. Both the cog holes 26 and the magnetic stripe 28 are optional, but preferred, and the version of the ticket stock 20 shown in FIG. 2 has neither.

At that portion of the ticket stock 20 which lies at the end of each individual ticket 22, there is a transversely extending means 30 for aiding in the separation of the individual tickets 22 from the remaining ticket stock 20. A preferred form of the means 30 is present in FIG. 1, and is shown in greater detail in FIGS. 2 and 3.

The means 30 includes at least one perforation 32 through the ticket stock 20, and preferably a series of perforations 32 extending transversely to the elongated direction of the ticket stock 20. The perforations 32 do not, however, extend the entire width of the ticket stock 20. An elongated bursting slot 34 extends a portion of the width of the ticket stock 20. The bursting slot is of a size sufficiently large in length and width to be engaged by a burst barb on the dispensing machinery, to be discussed subsequently At each end 36 of the bursting slot 34 are slits 38 extending transversely therefrom. The slits concentrate the stress at the ends of the slot 34 during the ticket separation process, so that separation occurs in a well-defined tearing movement that begins at the slot ends and extends outwardly in the transverse direction. The perforations 32, bursting slot 34, and slits 38 are all located at the ticket end 24, where the individual tickets 22 are to be separated, and are substantially collinear along a separation line 40 to produce a smooth separation and end of the separated ticket. Optionally, notches 42 can be provided at each end of the separation line 40. The notches may aid in achieving ticket separation, but their principal function is to prevent edge curling of the separated ticket 22 so that the ticket 22 may be more easily handled through other automated fare collection equipment.

The mechanics of the separation of an individual ticket 22 from the ticket stock 20 are best understood in relation to the separation portion of the dispensing apparatus, which will be described next.

Figure 4:
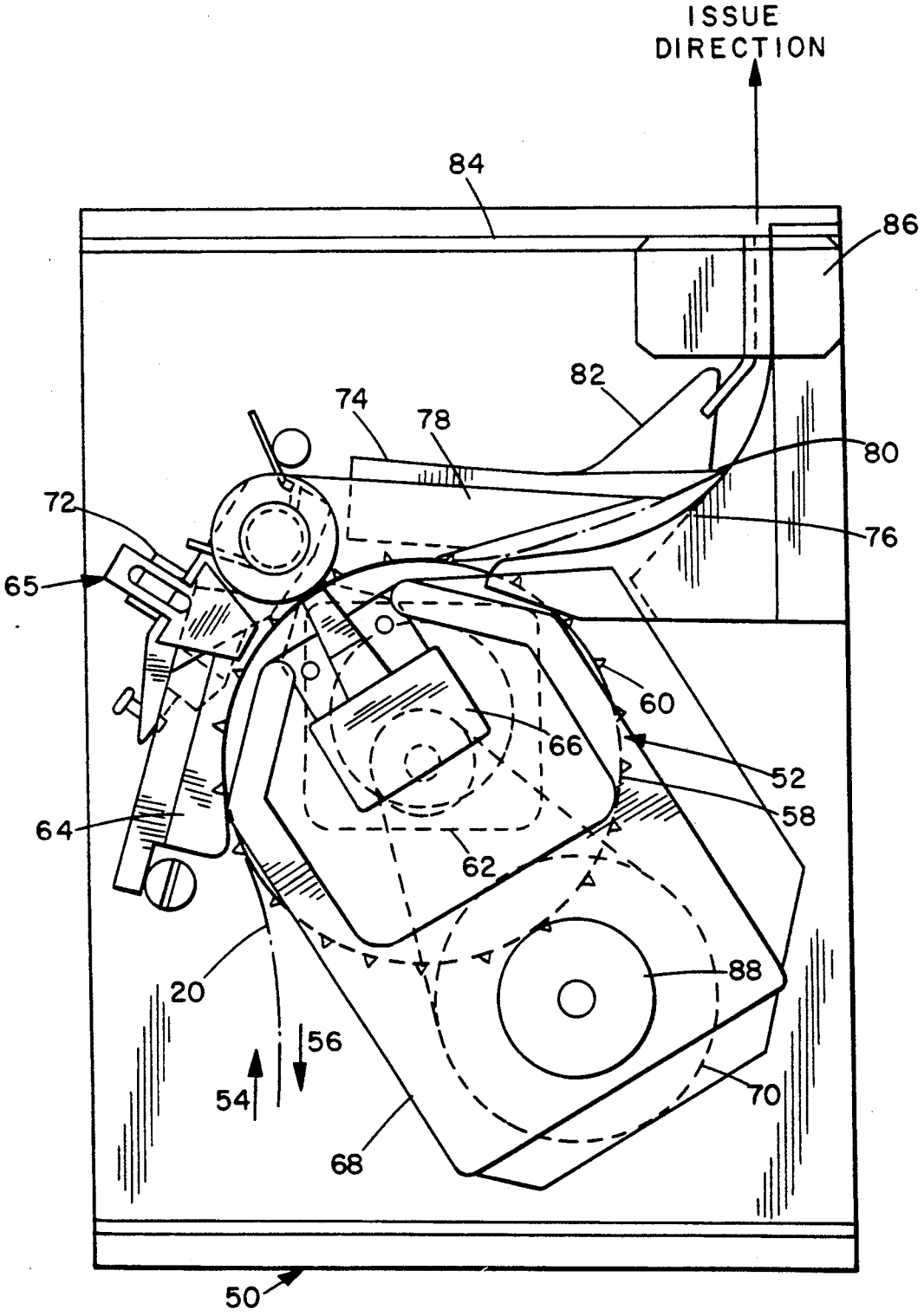
FIG. 4 is an elevational view of a ticket dispenser, with covers and obscuring structure removed so that the mechanism may be seen clearly, and with some features that are out of the field of view depicted in phantom lines.

FIG. 4 illustrates a preferred form of a dispenser 50 that prints and dispenses individual tickets 22 from the ticket stock 20 (The preferred dispenser 50 happens to be a dispenser for mass transit transfers, but is not so limited.) The ticket stock 20 is engaged by a means for driving 52 the ticket stock in both a forward direction 54 and a reverse direction 56. The preferred means includes a tractor drive capstan wheel 26 having cogs 60 thereon that engage the cog holes 26 of the ticket stock 20, and provide a positive engagement and drive in either direction 54 or 56. The capstan wheel 58 is rotationally driven by a DC motor 62. A preferred DC motor 62 is a 24 volt motor made by Merkle-Korff, although the invention is not so limited.

The ticket stock 20 is fed by the means for driving 52 to an input guide 64, which is a solid piece of plastic or metal that bends the ticket stock 20 into an arc. For use in the dispenser 50 depicted in FIG. 4, the ticket stock 20 has a magnetic stripe such as shown in FIG. 1, and the magnetic stripe is on the outside of the arc. A sensor 65 senses the leading edge of the ticket stock 20. The sensor 65 is preferably a reflective light sensor such as that commercially available from Optec. Using the sensor signal together with the known calibrated movement of the DC motor 62 and the signal produced by a shaft rotational position sensor 88, it is possible to calculate the position of the ticket stock 20 within the dispenser 50.

The input guide 64 directs the ticket stock 20 past a printer and a magnetic encoder. A printer 66 prints human-readable text information onto the ticket stock 20, preferably on the side opposite the magnetic stripe since there is more room on the ticket for the printing and because the opposite-side printing permits a more compact dispenser 50. The printer 66 can be of any acceptable form, but is preferably a K1200 model made by Microlys. This printer 66 requires an inked ribbon, and a ribbon cartridge 68 and ribbon drive 70 are also provided.

A magnetic stripe encoder 72 is oppositely disposed to the printer 66, facing the magnetic stripe 28 on the ticket stock 20. (Devices for placing information into a magnetic stripe and reading that information are sometimes termed read/write heads, and the term "magnetic stripe encoder" used herein is intended to be synonymous with such other usages.) The magnetic stripe printer 72 can be of any operable type, and many are available commercially, but is preferably of the type available from Brush Industries. The encoder 72 includes both a write head, which is essentially an electromagnet that magnetizes regions on the magnetic stripe, and a read head, which is essentially an induction coil in which a current is induced when a magnetized portion of the magnetic stripe passes thereunder.

The printer 66 and the encoder 72 are operated to deposit information only onto one individual ticket 22 on the ticket stock 20 at a time, and at this time the individual ticket 22 is not separated from the ticket stock 20. After leaving the printer 66 and the encoder 72, the ticket stock 20 passes through an output guide 74. The output guide 74 includes guide portions on both sides of the ticket stock 20. An outer guide 76 is a curved piece of plastic or metal that bends the ticket stock 20 into an arc. An inner guide 78 is a straight piece of plastic or metal angled in the output direction and positioned to press against the ticket stock 20 along the inside curvature of the arc, as necessary, to ensure that the ticket stock 20 continues to follow the generally arced path defined by the outer guide 76.

A burst barb 80 extends from the end of the inner guide 78. The burst barb 80 is a strip of metal dimensioned to fit within and engage the bursting slot 34 of the ticket stock 20 (but sufficiently wide that it will not slip into any of the cog holes 26). The burst barb 80 is spaced sufficiently far from the outer guide 76 so that the ticket stock 20 may pass therebetween. However, because of the curvature of the ticket stock 20 at that location, the ticket stock 80 is biased to press toward the center of its arc and against the end of the burst barb 80. Thus, as the ticket stock 20 is driven in the forward direction 54, the burst barb 80 slides along the concave surface of the ticket stock 20. An optional ticket support finger 82 extends upwardly from the inner guide 78, just behind the burst barb 80.

All of these components are mounted to a backbone plate 84, making the dispenser 50 a readily removable and replaceable unit in a mass transit system or otherwise.

A bezel guide 86, in the form of a housing sufficiently large for passage of an individual ticket 22, is positioned just beyond the output guide 74 and burst barb 80.

In operating the dispenser 50, a strip of ticket stock 20 is provided from a supply (not shown). The ticket stock 20 may be supplied either on a roll or in fan-fold form. To load the dispenser 50, the input guide 64 is removed, the ticket stock 20 is engaged to the cogs 60 of the capstan wheel 58, and the input guide 64 is replaced to hold the ticket stock 20 in place. The DC motor 62 drives the ticket stock past the sensor 65 to a position where the leading edge of the ticket stock 20 is nearly adjacent the burst barb 80. The dispenser 50 is then ready for the first printing operation.

Figure 5:
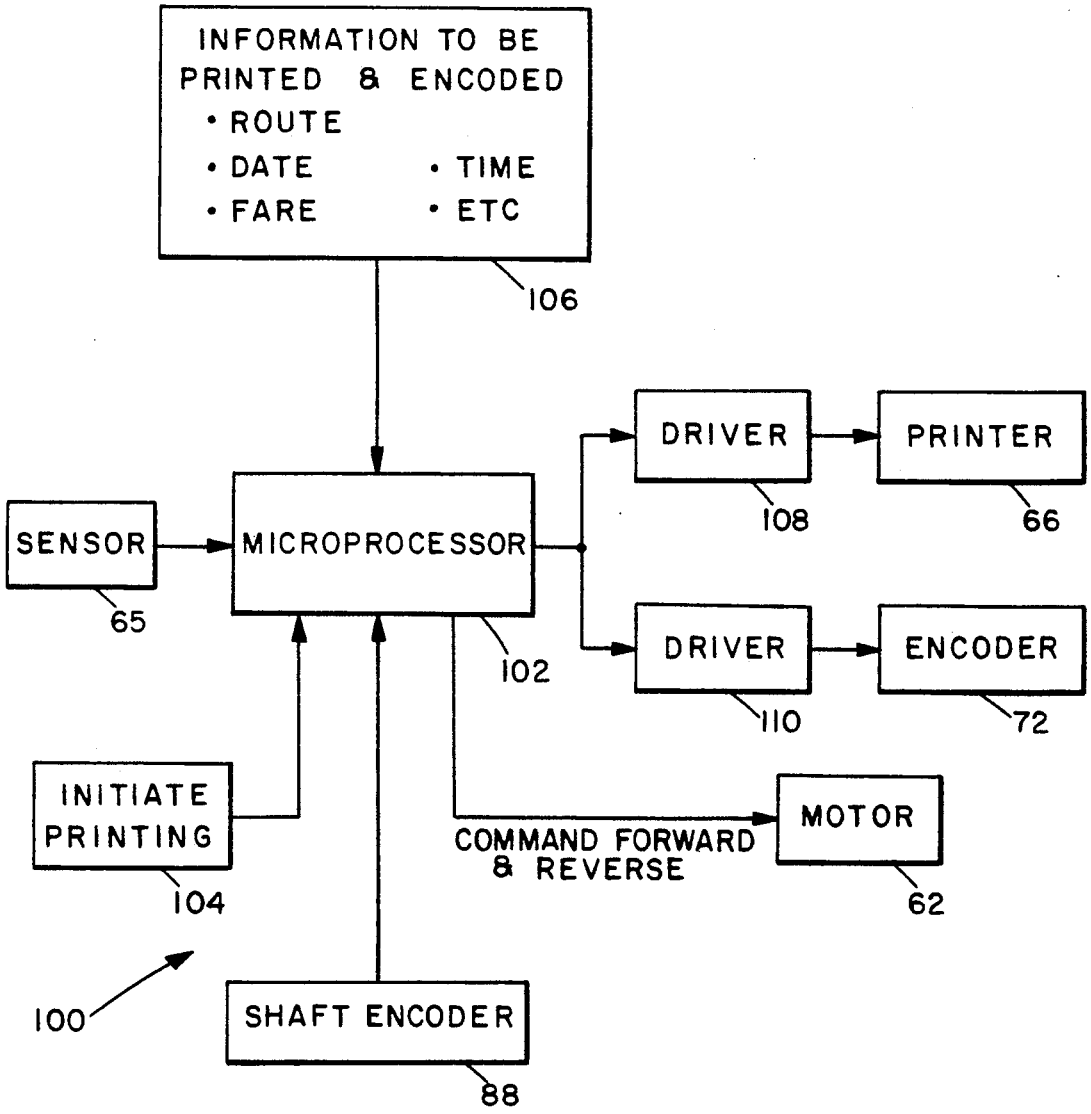
FIG. 5 is a block diagram of the control system of the dispenser.

Printing and dispensing is controlled by a control system 100, illustrated in schematic form in FIG. 5. A microprocessor 102 coordinates the form in activities. When the ticket stock 20 is loaded, the microprocessor receives a leading edge signal from the sensor 65. The microprocessor drives the motor 62 in the forward direction while measuring the signal of the shaft encoder 88, to bring the ticket stock 20 to the printing position.

When printing and dispensing of an individual ticket 22 is to occur, the microprocessor 102 receives an "initiate" command 104 either from a manual switch or any other appropriate source. The microprocessor 102 reads the information to be printed from a memory or buffer 106. The information to be printed by the human-readable printer 66 is sent to a driver 108, which provides a format suitable for the printer 66. The information to be printed by the magnetic stripe encoder 72 is sent to a driver 110, which provides a format suitable for the encoder 72.

When the data is ready, the microprocessor 102 commands the motor 62 to drive the ticket stock 20 in the reverse direction, and as the ticket stock 28 moves past the printer 66 and the magnetic stripe encoder 72, the information is printed and encoded onto the ticket stock 20. The information is printed entirely within the length between the leading edge of the ticket stock and the first end to be separated to form an individual ticket 22. As the shaft encoder 88 turns, it continuously reports the number of increments to the microprocessor 102, so that the actual position can be determined. After the ticket stock 20 has been driven a sufficient distance, the microprocessor 102 commands the motor 62 to change direction to drive the ticket stock in the forward direction 54. As the ticket stock 20 passes the read sensor of the encoder 72, the magnetically encoded information on the magnetic stripe 28 is read and verified by the microprocessor 102. If the information is incorrect, the encoding of the magnetic stripe is repeated. The human-readable information is not reprinted by the printer 66. If the information obtained by reading the magnetic stripe 28 is correct, the separation procedure begins.

Separation of an individual ticket 22 is accomplished by driving the leading edge of the ticket stock 20 in the forward direction past the burst barb 80, for a sufficient distance that the bursting slot 34 of the ticket stock 20 is either at or past the point at which it engages the burst barb 80. It is acceptable if the ticket stock 20 is driven slightly past the burst barb 80, because in the next step the microprocessor 102 commands the motor 62 to reverse, and drive the ticket stock 20 in the reverse direction 56. The ticket stock 20, engaged to the bursting barb 80 by the bursting slot 34, is pulled in the reverse direction 56. The engagement causes the ticket stock 20 to be pulled away from the outer guide 76 (toward the ticket support finger 82, if one is present). The ticket stock 20 bends slightly in a symmetrical manner about is centerline, producing an out-of-plane tearing stress which is large in the region of the bursting slot 34. The slits 38 at the ends of the bursting slot 34 act as the initiation site for a tear of the ticket stock 20 along the separation line 40, and that tear propagates along the perforations 32 in a transverse direction toward the sides of the ticket stock 20. When the tear reaches the sides, the individual ticket 22 is separated, pops up slightly as the bending strain energy of the bent stock is relieved, and can be removed by the patron through the bezel guide 86.

In the operation of a working model of the dispenser 50 using the ticket stock 20 as described herein, tickets (here rapid transit transfers) were dispensed in less than one second after the initiation of the operation 104. By comparison, conventional printers that use a cutter require about seconds to achieve the same result. This difference is important to rapid transit system management, because a shorter dispensing time relieves lines and crowding. Significantly, the leading edge and trailing edge of each ticket, produced by the "bursting" method of the present dispenser, were smooth and suitable for insertion into and reading by automatic fare collection apparatus at other parts of the mass transit system.

The approach of the present invention has the additional features that the ticket stock is readily manufactured by conventional die-cutting procedures. Dies cut the perforations, bursting slot, and slit into the ticket stock in a conventional manner. The dispenser has few moving parts to fail, and, significantly, no conventional cutter apparatus that employs a moving blade to separate the individual tickets from the ticket stock. This reduction in moving parts, and absence of a cutter apparatus that has been known previously to experience a high incidence of failures during operation, increases the mean time between failures of the dispenser significantly Because the dispenser may be at a location where replacement cannot be made immediately, as on a mobile bus or street car, a long mean time between failures is important. However, when repair or replacement is required, the dispenser of the invention can be removed as a unit by disconnecting electrical leads and removing the support plate 34. A replacement unit is inserted, the electrical leads are reconnected, the ticket stock is reloaded, and the ticket dispenser is ready for immediate operation.

Although particular embodiments of the invention have been described in detail for purposes of illustration, various modifications may be made without departing from the spirit and scope of the invention Accordingly, the invention is not to be limited except as by the appended claims.

What is claimed is:

1. A dispenser that separates a single ticket from an elongated strip of ticket stock having a transverse bursting slot therein at the location whereat the single ticket is to be separated, comprising:

means for driving a strip of ticket stock in both a forward direction and a reverse direction along the direction of elongation;

means for separating a single ticket from the strip, comprising a burst barb, and means for permitting the ticket to move past the burst barb when the strip of ticket stock is driven in the forward direction, and for engaging the burst barb into a bursting slot in the strip of ticket stock when the strip of ticket stock is driven in the reverse direction, the means for separating having no paper cutter therein.

2. The dispenser of claim 1, further including means for printing human-readable information onto the ticket.

3. The dispenser of claim 1, wherein the strip of ticket stock includes a magnetic strip thereon, and the dispenser further includes means for encoding magnetically encoded information onto the magnetic strip.

4. The dispenser of claim 1, wherein the means for permitting and for engaging includes a concavely upwardly curved guide extending from below and behind the burst barb to above and in front of the burst barb, the spacing between the burst barb and the curved guide being sufficiently small that the strip of ticket stock is bent toward the curvature of the guide at it passes along the guide.

5. The dispenser of claim 1, wherein the means for separating further includes a ticket support finger extending upwardly from, and set back from the tip of, the burst barb.

6. The dispenser of claim 1, wherein the burst barb is formed of a strip of metal having a width less than the width of the bursting slot.

* * * * *